United States Patent [19]

Koike et al.

[11] Patent Number: 4,948,282

[45] Date of Patent: Aug. 14, 1990

[54] DRIVE DEVICE FOR A THERMAL TRANSFER PRINTER

[75] Inventors: Seiji Koike; Yukihiro Hirosaki; Motonobu Hamada; Takahiko Ohata, all of Shizuoka, Japan

[73] Assignee: Tokyo Electric Co., Ltd., Tokyo, Japan

[21] Appl. No.: 813,584

[22] Filed: Dec. 26, 1985

[30] Foreign Application Priority Data

Dec. 25, 1984 [JP] Japan ..... 59-278593

[51] Int. Cl.[5] ..... B41J 11/30

[52] U.S. Cl. ..... 400/616.2; 101/288

[58] Field of Search ..... 226/170, 196; 400/616, 400/616.2, 616.3, 571, 616.1

[56] References Cited

U.S. PATENT DOCUMENTS

| | | | |
|---|---|---|---|
| 2,261,359 | 11/1941 | Gantier | 226/170 |
| 3,650,448 | 3/1972 | Jarmy | 226/196 |
| 3,998,313 | 12/1976 | Hickey | 400/616.2 |
| 4,039,065 | 8/1977 | Seki et al. | 400/120 |
| 4,139,168 | 2/1979 | Alberding | 226/170 |
| 4,160,606 | 7/1979 | Caenazzo | 400/616.2 |
| 4,213,135 | 7/1980 | Medvecky | 400/120 |
| 4,560,292 | 12/1985 | Takahashi | 101/288 |
| 4,573,059 | 2/1986 | Shinma et al. | 400/120 |
| 4,577,199 | 3/1986 | Saiki et al. | 400/240.3 |

FOREIGN PATENT DOCUMENTS

| | | | |
|---|---|---|---|
| 194909 | 2/1908 | Fed. Rep. of Germany | 226/170 |
| 2785 | 1/1982 | Japan | 400/616.3 |
| 154412 | 9/1983 | Japan | 226/170 |

OTHER PUBLICATIONS

Sobey, "Continuous Form Paper . . . ", IBM Technical Disclosure Bulletin vol. 22, No. 5, pp. 1751–1752, 10/79.

Bostwick, "Forms Tractor", IBM Technical Disclosure Bulletin, vol. 10, No. 10, pp. 1481–1482, 3/68.

*Primary Examiner*—Edgar S. Burr

*Assistant Examiner*—Joseph R. Keating

*Attorney, Agent, or Firm*—Oblon, Spivak, McClelland, Maier & Neustadt

[57] ABSTRACT

The invention provides a drive device for a thermal transfer printer of the type which includes a thermal head for printing data on a label on a mount by way of an ink ribbon. A platen roller contacts the mount having a label thereon. The mount is also contacted by the thermal head so that the mount may be fed by a rotational frictional force of the platen roller. Sprockets are mounted for free rotation and for engagement in sprocket holes formed in the mount. Thus, a mount having a label thereon is fed by a rotational frictional force of the platen roller which is contacted under pressure by the thermal head. As the mount is fed, the movement thereof is guided and hence corrected by the freely rotating sprockets. As a result, the mount can be transported assuredly without causing meandering or slipping thereof, thereby allowing high quality printing to be attained without dislocation of printed symbols.

16 Claims, 3 Drawing Sheets

DRIVE DEVICE FOR A THERMAL TRANSFER PRINTER

FIELD OF THE INVENTION

This invention relates to a thermal printer for printing on a label applied to a mount in the form of a web having sprocket holes formed therein, and more particularly to a drive device for a thermal transfer printer which includes a thermal head for printing data on a label on a mount by way of an ink ribbon.

BACKGROUND OF THE INVENTION

A conventional drive device for a thermal transfer printer of this type is shown in FIG. 5. The drive device includes a platen roller 2 to which a fixed pressure is applied by means of a thermal head 1. A mount 4 and an ink ribbon 5 put between the platen roller 2 and the thermal head 1. The mount 4 has labels 3 applied thereto. The platen roller 2 is driven to rotate so that the mount 4 and the ink ribbon 5 are fed only by a frictional force of the platen roller 2 upon such rotation.

In a drive system of such a conventional type, the mount 4 (label 3) may be caused to meander due to a delicate difference between pressing forces at left and right positions between the thermal head 1 and the platen roller 2, or the feeding amount of the labels may sometimes show variations because of slips in the friction drive, resulting in a bad quality of print on labels.

OBJECT OF THE INVENTION

It is an object of the present invention to provide a drive device for a thermal transfer printer which can eliminate meandering and variations of the feeding amount of labels to improve the label print quality.

SUMMARY OF THE INVENTION

In order to attain this object, according to the invention, a drive device for a thermal transfer printer of the type which includes a thermal head for printing data on a label on a mount by way of an ink ribbon comprises a platen roller with which the mount having a label thereon is contacted by the thermal head so that the mount may be fed by a rotational frictional force of the platen roller, and sprockets mounted for free rotation and for engagement in sprocket holes formed in the mount.

DETAILED DESCRIPTION OF THE PREFERRED EMBODIMENTS

Figure 1:
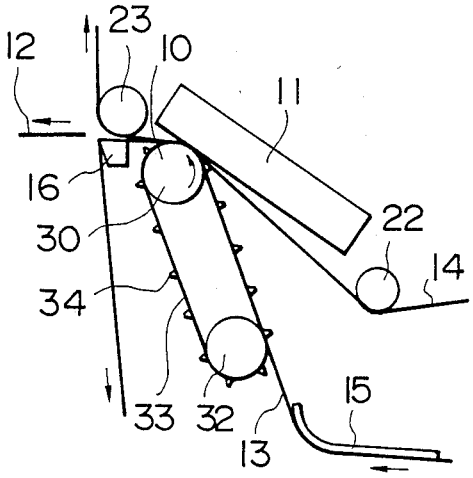
FIG. 1 is a schematic side elevational view illustrating a first embodiment of the present invention.

At first, a first embodiment of the present invention will be described with reference to FIGS. 1 to 3. Referring first to FIG. 3 (which illustrates a general construction of an entire thermal transfer printer), the printer includes a thermal head 11 which is contacted with a platen roller 10 by a predetermined pressure. A mount 13 having labels 12 thereon and an ink ribbon 14 for thermal printing are fed for printing between the platen roller 10 and the thermal head 11. The mount 13 is delivered from a roll 9 and guided by a guide 15. After the mount 13 has passed the thermal head 11, it is bent sharply by a sharply angled exfoliating plate 16 so that it is exfoliated thereby for issuance thereof. Downstream of the exfoliating plate 16, the mount 13 passes between a mount drawing roller 17 and a pinch roller 18 and is wound up by a winding means not shown. On the other hand, the thermal head 11 is integrated into an ink ribbon unit 19 which is mounted for opening and closing operation around a fulcrum 20 relative to the platen roller 10. The ink ribbon 14 extends from a supply pulley 21 to a takeup pulley 24 passing a plurality of guide pulleys 22 and a tension pulley 23.

In this construction, the mount 13 is fed by a rotational frictional force of the platen roller 10. However, the present embodiment includes a label meandering preventing system employing sprockets in addition to such a platen roller feeding system. This arrangement will now be described with reference to FIGS. 1 and 2. The platen roller 10 is integrally secured to a shaft 25 and is connected to be driven to rotate by a stepping motor 29 by way of a pulley 26, a belt 27 and a motor pulley 28. A pair of sprocket belt pulleys 20 are located adjacent opposite ends of the platen roller 10 and are mounted for free rotation on the shaft 25 by means of a pair of bearings 31. Another pair of sprocket belt pulley 32 is also provided upstream of the sprocket belt pulleys 30, and a sprocket belt 33 extends between each pair of the pulleys 30 and 32. A plurality of sprockets 34 are formed in equidistant relationship on each sprocket belt 33 and are designed to engage in sprocket holes 35 formed along opposite edges of the mount 13. Here, the sprocket belts 33 on the sprocket belt pulleys 30 has substantially the same diameter as the platen roller 10.

Figure 2:
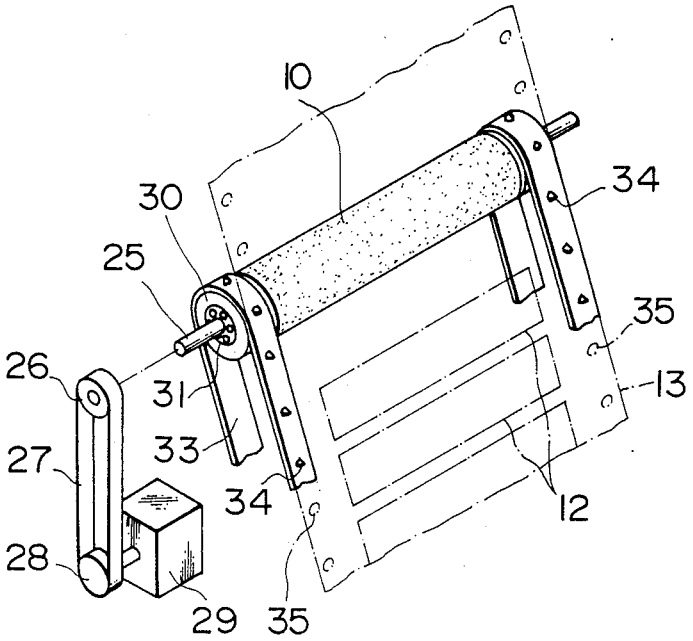
FIG. 2 is a perspective view of the device of FIG. 1.
Figure 3:
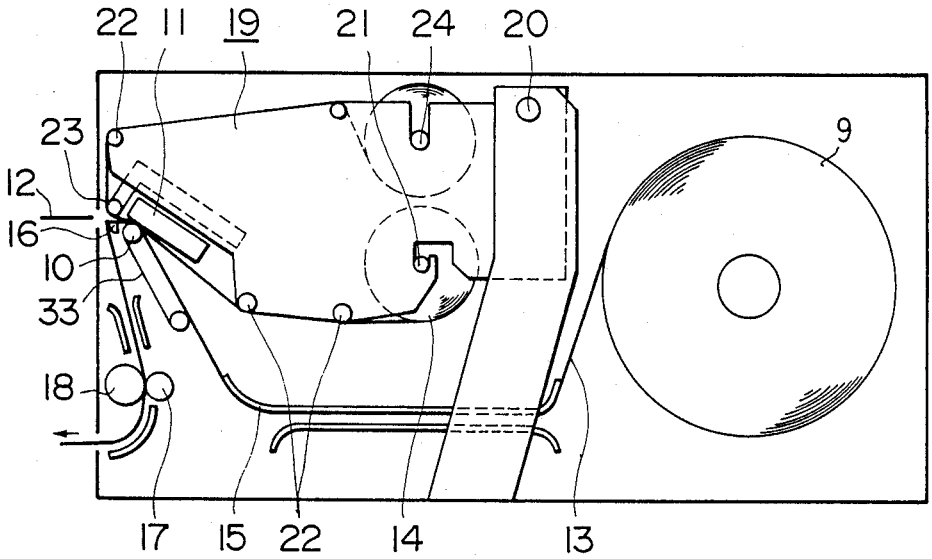
FIG. 3 is a schematic side elevational view of an entire printer.

In this construction, the mount 13 is set such that some of the sprocket holes 35 may engage with the sprockets 34 on the sprocket belt 33 as shown in FIG. 2. Thus, if the platen roller 10 is driven to rotate by the stepping motor 29, the mount 13 is fed by a rotational frictional force of the platen roller 10 since the thermal head 11 is pressed against the platen roller 10 by a predetermined pressure. In this instance, since the sprocket belts 33 can freely rotate, the sprockets 34 is rotated freely following the movement of the sprocket holes 35 of the mount 13. However, if a case where the mount 13 (label 12) is going to meander is considered, the mount 13 is guided at the left and right in the feeding direction thereof by engagement of the sprockets 34 with the sprocket holes 35, and since the sprocket belts 33 can rotate freely, the movement of the mount 13 is corrected so as not to meander by such movement of the sprocket belts 33. This also applies to the feeding direction of the mount 13, and hence the mount 13 can be fed assuredly without any slip. Since the mount 13 (label 12) can be fed smoothly in this way, high quality printing can be effected on the labels 12. Thus, since the sprockets 34 contributes not directly but supplementarily to feeding of the mount 13, the mount 13 will not be damaged at the sprocket holes 35 thereof, and hence the pitch distance between the sprocket holes 35 will not get out of order, resulting in assured feeding of the mount 13.

Figure 4:
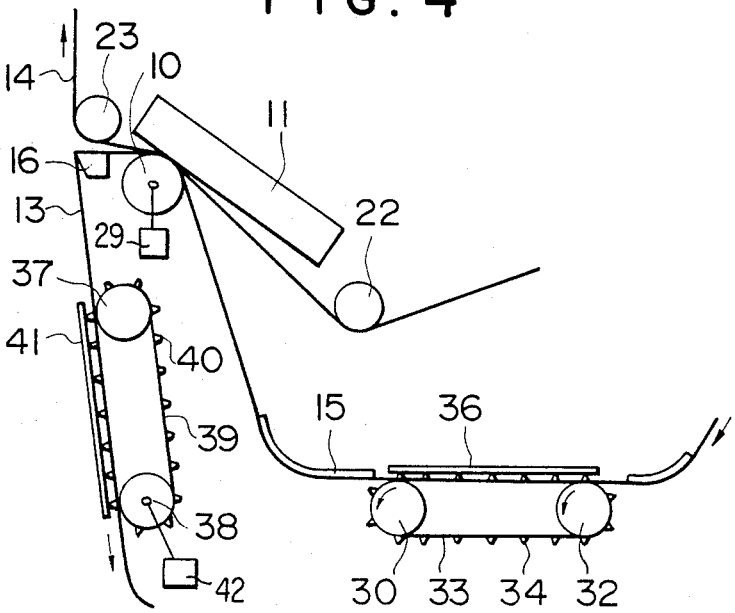
FIG. 4 is a schematic side elevational view illustrating a second embodiment of the invention.
Figure 5:
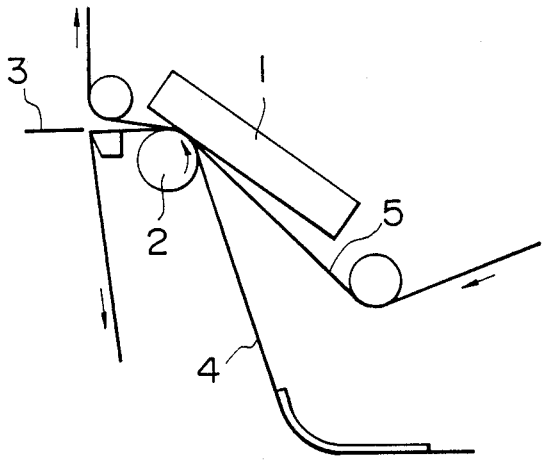
FIG. 5 PRIOR ART
FIG. 5 is a schematic side elevational view illustrating a conventional device.

Now, a second embodiment of the present invention will be described with reference to FIG. 4. In the second embodiment, only a platen roller 10 connected to be driven by a stepping motor 29 is located in opposing relationship to a thermal head 11. At a stage upstream of the printing mechanism, a sprocket mechanism including a pair of sprocket belt pulleys 30 mounted for free rotation, a pair of sprocket belts 33, and a plurality of sprockets 34 is located adjacent a label guide 15. Reference numeral 36 denotes a sprocket cover for holding down the labels 12. This construction can also prevent meandering of a label, and hence the structure around the printing position can be simplified. Further in the second embodiment, another sprocket mechanism including two pairs of sprocket belt pulleys 37 and 38 connected to be driven to rotate by a motor 42 in place of the mount drawing rollers 17 and 18, two sprocket belts 39 and a plurality of 40 are located in a stage downstream of an exfoliating plate 16. Reference numeral 41 denotes a sprocket cover mounted for opening and closing movement. By drawing the mount 13 with such a sprocket mechanism, a drawing force which is greater than that obtainable by the roller system (that is, a tensile force sufficient to exfoliate a label 12 from the mount 13) can be obtained easily by the exfoliating plate 16, resulting in assured exfoliation of labels.

As is apparent from the foregoing description, according to the present invention, a drive device for a thermal transfer printer employs a mount feeding system utilizing a rotational frictional force of a platen roller together with sprockets mounted for rotation. Accordingly, assured feeding of labels can be attained without causing meandering or slipping at a mount, and hence high quality printing can be effected always at exact positions on each label.

We claim:

1. A thermal transfer printer comprising:

(a) a supply pulley for a mount having a plurality of labels thereon;

(b) a supply pulley for an ink ribbon;

(c) a platen roller fixedly mounted on a shaft;

(d) a thermal head which is contacted with said platen roller by a predetermined pressure;

(e) first means for guiding the mount and the ink ribbon between said thermal head and said platen roller;

(f) second means for rotating said shaft, thereby feeding the mount and the ink ribbon between said platen roller and said thermal head;

(g) a first pair of sprocket belt pulleys journaled on said shaft outboard of said platen roller for free rotation relative to said shaft and, hence, the mount;

(h) a second pair of sprocket belt pulleys located upstream of said first pair of sprocket belt pulleys and outboard of the path of the mount, said second pair of sprocket belt pulleys also being journaled for free rotation relative to the mount; and (i) a pair of sprocket belts, each one of said sprocket belts being trained over one of said first pair of sprocket belt pulleys and a corresponding one of said second pair of sprocket belt pulleys and being positioned to engage sprocket holes in a corresponding edge of the mount.

2. A thermal transfer printer as recited in claim 1 and further comprising third means for stripping the labels from the mount downstream of said platen roller.

3. A thermal transfer printer as recited in claim 1 wherein the outer diameter of each one of said pair of sprocket belts as it turns around the associated one of said first pair of sprocket belt pulleys is at least substantially the same as the diameter of said platen roller.

4. A thermal transfer printer as recited in claim 1 wherein said thermal head is mounted for opening and closing movement relative to said platen roller.

5. A thermal transfer printer as recited in claim 4 wherein the movement of said thermal head relative to said platen roller is pivotal.

6. A thermal transfer printer comprising:

(a) a thermal head;

(b) a platen roller;

(c) first means for guiding a mount having a plurality of labels thereon and an ink ribbon between said thermal head and said platen roller;

(d) second means for rotating said platen roller, thereby feeding the mount and the ink ribbon between said platen roller and said thermal head;

(e) a first pair of sprocket belt pulleys located upstream of said platen roller and outboard of the path of the mount, said first pair of sprocket belt pulleys being journaled for free rotation relative to the mount;

(f) a second pair of sprocket belt pulleys located upstream of said first pair of sprocket belt pulleys and outboard of the path of the mount, said second pair of sprocket belt pulleys also being journaled for free rotation relative to the mount;

(g) a first pair of sprocket belts, each one of said first pair of sprocket belts being trained over one of said first pair of sprocket belt pulleys and a corresponding one of said second pair of sprocket belt pulleys and being positioned to engage sprocket holes in a corresponding edge of the mount; and (h) a first sprocket cover sized, shaped, and positioned to hold the mount in engagement with said first pair of sprocket belts.

7. A transfer printer as recited in claim 6 and further comprising:

(a) a third pair of sprocket belt pulleys located downstream of said platen roller and outboard of the path of the mount;

(b) a fourth path of sprocket belt pulleys located downstream of said third pair of sprocket belt pulleys and outboard of the path of the mount;

(c) a second pair of sprocket belts, each one of said second pair of sprocket belts being trained over one of said third pair of sprocket belt pulleys and a corresponding one of said fourth pair of sprocket belt pulleys and being positioned to engage sprocket holes in a corresponding edge of the mount;

(d) a second sprocket cover sized, shaped, and positioned to hold the mount in engagement with said second pair of sprocket belts; and (e) third means for driving said second pair of sprocket belts.

8. A thermal transfer printer as recited in claim 6 and further comprising fourth means for stripping the labels from the mount downstream of said platen roller.

9. A thermal transfer printer comprising:

(a) a supply pulley for a mount having a plurality of labels thereon;

(b) a platen roller fixedly mounted on a shaft;

(c) a thermal head which is contacted with said platen roller by a predetermined pressure;

(d) first means for guiding the mount between said thermal head and said platen roller;

(e) second means for rotating said shaft, thereby feeding the mount between said platen roller and said thermal head;

(f) a first pair of sprocket belt pulleys journaled on said shaft outboard of said platen roller for free rotation relative to said shaft and, hence, the mount;

(g) a second pair of sprocket belt pulleys located upstream of said first pair of sprocket belt pulleys and outboard of the path of the mount, said second pair of sprocket belt pulleys also being journaled for free rotation relative to the mount; and (h) a pair of sprocket belts, each one of said sprocket belts being trained over one of said first pair of sprocket belt pulleys and a corresponding one of said second pair of sprocket belt pulleys and being positioned to engage sprocket holes in a corresponding edge of the mount.

10. A thermal transfer printer as recited in claim 9 wherein said thermal head is mounted for opening and closing movement relative to said platen roller.

11. A thermal transfer printer as recited in claim 10 wherein the movement of said thermal head relative to said platen roller is pivotal.

12. A thermal transfer printer as recited in claim 9 and further comprising third means for stripping the labels from the mount downstream of said platen roller.

13. A thermal transfer printer as recited in claim 9 wherein the outer diameter of each one of said pair of sprocket belts as it turns around the associated one of said first pair of sprocket belt pulleys is at least substantially the same as the diameter of said platen roller.

14. A thermal transfer printer comprising:

(a) a thermal head;

(b) a platen roller;

(c) first means for guiding a mount having a plurality of labels thereon between said thermal head and said platen roller;

(d) second means for rotating said platen roller, thereby feeding the mount between said platen roller and said thermal head;

(e) a first pair of sprocket belt pulleys located upstream of said platen roller and outboard of the path of the mount, said first pair of sprocket belt pulleys being journaled for free rotation relative to the mount;

(f) a second pair of sprocket belt pulleys located upstream of said first pair of sprocket belt pulleys and outboard of the path of the mount, said second pair of sprocket belt pulleys also being journaled for free rotation relative to the mount;

(g) a first pair of sprocket belts, each one of said first pair of sprocket belts being trained over one of said first pair of sprocket belt pulleys and a corresponding one of said second pair of sprocket belt pulleys and being positioned to engage sprocket holes in a corresponding edge of the mount; and (h) a first sprocket cover sized, shaped, and positioned to hold the mount in engagement with said first pair of sprocket belts.

15. A transfer printer as recited in claim 14 and further comprising:

(a) a third pair of sprocket belt pulleys located downstream of said platen roller and outboard of the path of the mount;

(b) a fourth pair of sprocket belt pulleys located downstream of said third pair of sprocket belt pulleys and outboard of the path of the mount;

(c) a second pair of sprocket belts, each one of said second pair of sprocket belts being trained over one of said third pair of sprocket belt pulleys and a corresponding one of said fourth pair of sprocket belt pulleys and being positioned to engage sprocket holes in a corresponding edge of the mount;

(d) a second sprocket cover sized, shaped, and positioned to hold the mount in engagement with said second pair of sprocket belts; and (e) third means for driving said pair of sprocket belts.

16. A thermal transfer printer as recited in claim 14 and further comprising fourth means for stripping the labels from the mount downstream of said platen roller.

* * * * *